United States Patent [19]

McGrath

[11] Patent Number: 4,899,164

[45] Date of Patent: Feb. 6, 1990

[54] SLOT COUPLED MICROSTRIP CONSTRAINED LENS

[75] Inventor: Daniel T. McGrath, Fairfax, Va.

[73] Assignee: The United States of America as represented by the Secretary of the Air Force, Washington, D.C.

[21] Appl. No.: 245,843

[22] Filed: Sep. 16, 1988

[51] Int. Cl.[4] ..... H01Q 19/06

[52] U.S. Cl. ..... 343/754; 343/700 MS; 343/770

[58] Field of Search ..... 343/700 MS:753, 754, 343/846, 909, 770

[56] References Cited

U.S. PATENT DOCUMENTS

| | | | |
|---|---|---|---|
| 4,131,892 | 12/1978 | Munson et al. | 343/700 MS |
| 4,263,598 | 4/1981 | Bellee et al. | 343/700 MS |
| 4,316,194 | 2/1982 | DeSantis et al. | 343/700 MS |
| 4,329,689 | 5/1982 | Yee | 343/700 MS |
| 4,381,509 | 4/1983 | Rotman et al. | 343/754 |
| 4,489,328 | 12/1984 | Gears | 343/700 MS |
| 4,721,966 | 1/1988 | McGrath | 343/754 |

*Primary Examiner*—Rolf Hille

*Assistant Examiner*—Doris J. Johnson

*Attorney, Agent, or Firm*—William G. Auton; Donald J. Singer

[57] ABSTRACT

The microstrip constrained lens is a three-dimensional beamformer comprised of two printed circuit layers. The two circuit boards contain planar arrays of microstrip patches that face in opposite directions, to respectively collect and reradiate energy from a feed suspended behind the structure. It is a wide angle beamformer due to its use of two geometric degrees of freedom: the length of line joining front and back face lens elements varies with radius; and the back face elements are displaced radially instead of being placed directly behind their front face counterparts. An early version of this microwave lens used feed-through pins. In the most recent design the feed-through pins of the first model were replaced with a solderless slot coupler, or capacitive coupler. Without the need to solder the many hundreds of feed-throughs, the device is much easier to fabricate, and its performance is better because there is no degradation introduced by misalignment of the feed-through pins.

6 Claims, 9 Drawing Sheets

SLOT COUPLED MICROSTRIP CONSTRAINED LENS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to beam forming lenses used with antennas which scan electronically in azimuth and elevation, and more specifically to a microwave antenna system that is capable of wide angle scanning, and thus can be used in applications that scan by switching between elements of an array feed positioned behind the lens.

Examples of curved reflectors and lenses that are both commonly used as collimating elements in high-gain, narrow beam microwave antennas as described in the following U.S. Patents, the disclosure of which are incorporated herein by reference:

U.S. Pat. No. 4,721,966 issued to Daniel McGrath;
U.S. Pat. No. 4,381,509 issued to Walter Rotman;
U.S. Pat. No. 4,131,892 issued to Robert Munson et al;
U.S. Pat. No. 4,263,598 issued to Ernest Bella et al; and
U.S. Pat. No. 4,329,689 issued to Jones Yee.

The microwave lens systems of the above-cited references may be used in a number of different applications including communications and direction finding. The choice between a reflector or lens for a given application depends upon many factors. For example, the Rotman lens is considered the optimum beamformer for producing time-delay steered beams over wide angles, but its requirement of a curved back face prohibits application to some problems, most notably those requiring large planar arrays.

Alternatives to the Rotman lens include curved wide-angle lenses and planar lenses. These lens systems are known in the art, and each possess advantages and disadvantages. For example, a planar lens (with a planar front surface which is parallel to a planar back surface) is incapable of wide-angle scanning, because the elements of the back face are normally placed directly behind the front face elements. Curved wide-angle lenses are heavy and expensive to build.

The basic microstrip constrained lens was described in U.S. Pat. No. 4,721,966, "Planar Three-Dimensional Constrained Lens for Wide-Angle Scanning." That patent described the design of a wide-angle microwave lens. It was an improvement over previous microwave lenses, such as the Rotman lens, which were limited to scanning in one plane only.

The present invention is a modification to the lens described in U.S. Pat. No. 4,721,966. That earlier lens used a pin coupler to route microwave energy from one side of the lens to the other The new version of the present invention uses a slot coupler. The efficiency of power transfer through the two lens systems in experiments was found to be approximately the same. Since the slot coupler does not require drilling a hole for a pin or soldering it to the open transmission line ends, it is much easier to build, and therefore less expensive. It is very lightweight, due to its construction from a circuit board.

From the foregoing discussion, it is apparent that a lightweight scanning lens antenna which uses a planar lens, yet is capable of performing wide-angle scanning would be a welcome addition to the art of beamforming lens design. The present invention is intended to provide a new lightweight design which uses a planar lens, yet is capable of wide-angle scanning

SUMMARY OF THE INVENTION

The present invention is a beamforming lens system for use with an antenna which is electronically steered. This is an improved version of the above-cited McGrath beamforming lens system and is composed of: a planar lens, a plurality of aperture antenna element radiators, a plurality of feed antenna element radiators, a plurality of aperture side and feed side transmission lines, and a ground plane with a plurality of feed-through slots. The planar lens houses the plurality of aperture antenna element radiators on its face so that they are each electronically connected to corresponding feed elements by the aperture side and feed side transmission lines whose lengths vary as a function of radius. Each of the corresponding aperture side and feed side transmitting lines terminate above one of the feed-through slots in the ground plane. These feed-through slots permit the energy of microwave signals to pass between the aperture side and feed side transmission lines in the manner discussed below.

The microwave antenna of the present invention is used to receive a microwave signal from a transmitting antenna located some arbitrary distance away from the antenna (the experiments used a transmitter one quarter mile away). The front lens face collects energy from the transmitter, which is in the form of a plane wave. The back face reradiates a focused wave toward the corporate feed, which collects the focused energy and routes it to a microwave receiver. Each of the aperture antenna element radiators collects the microwave energy of the plane wave, which is conducted through its aperture side transmission line, re-radiated through the slot in the ground plane, and conducted through the feed side transmission line to the feed antenna element radiator.

The microwave antenna of the present invention resembles that of the above-cited McGrath patent except for the use of the feed-through slots in the ground plane instead of conducting pins to connect the transmission lines. The electric field distribution in the feed-through slot approaches the electric current distribution of the conducting pins such that the electrical performance of the microwave antenna which uses the slots approaches that of the antenna which uses conducting pins. One of the advantages of the use of slots instead of pins is that the antenna will have a significant loss of weight without any significant change in performance. Weight reduction is particularly important to airborne radar systems such as the Aria Phased Array Telemetric System (APATS) used by the U.S. Air Force.

It is an object of the present invention to provide a beamforming lens design which uses a lightweight planar lens, yet is capable of wide-angle scanning.

It is another object of the present invention to provide a lightweight beamforming lens system which, when combined with an array feed, can be used for applications that require multiple beams and/or electronic scanning, such as satellite communication antennas.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a slot coupled microstrip constrained lens which serves as a microwave antenna. This system is an improvement over the basic microstrip constrained lens, which was described in U.S. Pat. No. 4,271,966 entitled "Planar Three-Dimensional Constrained Lens for Wide-Angle Scanning." That patent described the design of a wide-angle microwave lens which used a pin coupler to route microwave energy from one side of the lens to the other, as discussed briefly below. The present invention uses a slot coupler instead of a pin coupler. Since the slot coupler does not require drilling a hole for a pin or soldering it to the open transmission line ends, it is much easier to build, and therefore less expensive. It is very lightweight, due to its construction from circuit board.

The above-cited reference of Rotman provides a description of the Rotman lens principle. That is, an increase in the transmission line length between an outer lens contour point, and an inner lens contour point produces a corresponding increase in phase in an electrical signal as it travels between the outer and inner points. For example, if the transmission line increases by one-half a wavelength, the phase of the signal will increase by 180 degrees. Rotman correlates the changes with the transmission line lengths W directly with the resultant focal arc in wide-angle lens applications. The principles of the Rotman lens are used in the present invention, with the following modifications discussed below.

The Rotman lens, of the above-cited Rotman reference, is a curved lens which relies upon the contour of the curve to provide the changes in length of the transmission lines between the front and back side of the lens. The present invention produces the changes in transmission line lengths by the changes in the radial distribution of the feed antenna elements. The wide angle performance of the resultant focal arc are a natural concomitant, consequent, and result of the carefully selected adjustments of transmission lines length, as discussed in the Rotman reference.

Figure 1:
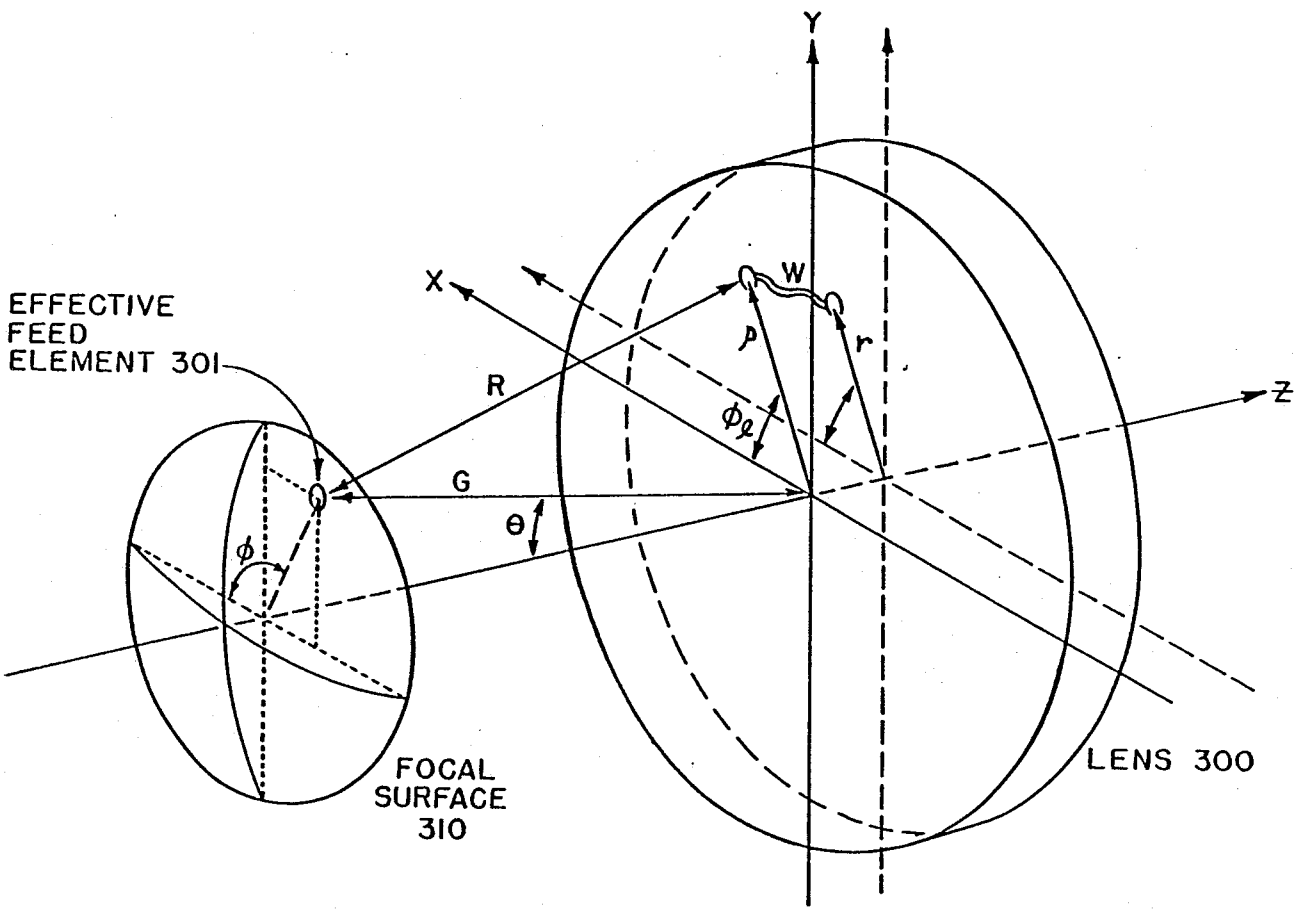
FIGURE 1 PRIOR ART
FIG. 1 is an illustration of a prior art beamforming lens system with linear lens geometry.
Figure 2:
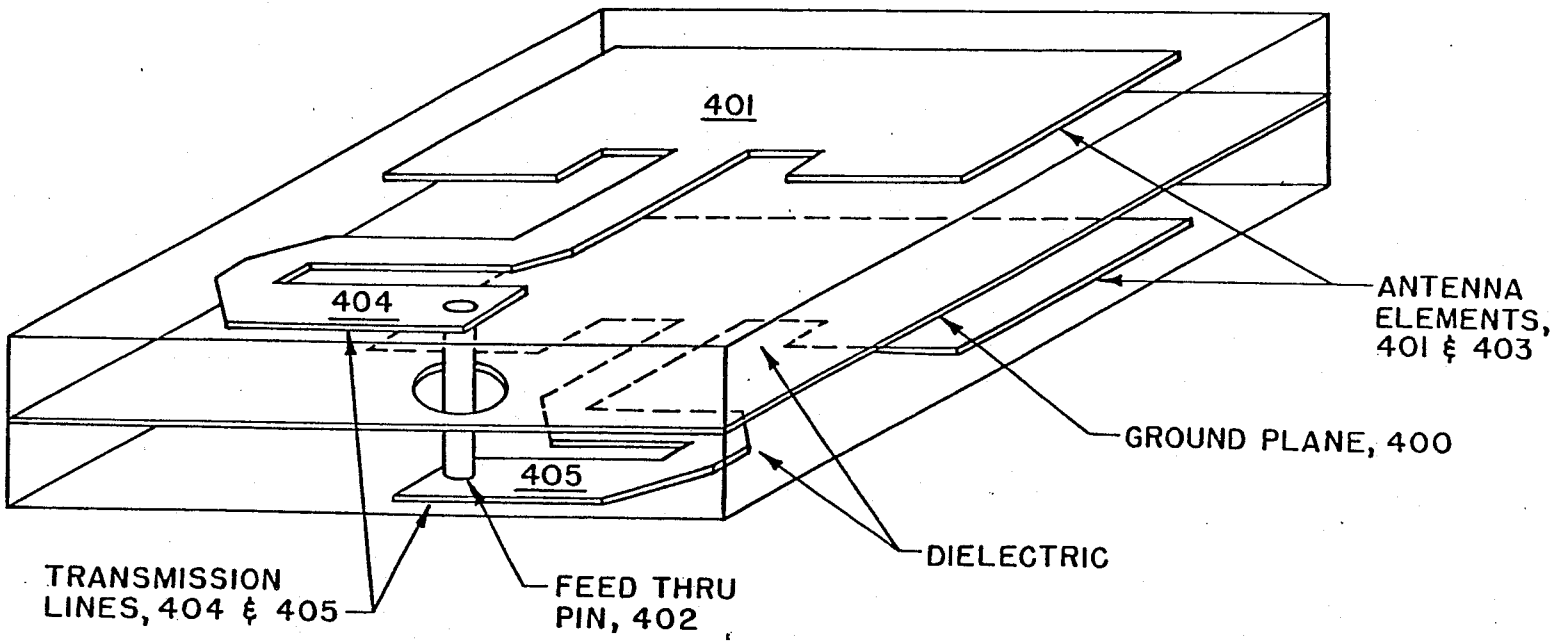
FIGURE 2 PRIOR ART
FIG. 2 is a perspective view of a section of microstrip of the lens of a prior art lens system.

The reader's attention is now directed towards FIGS. 1 and 2 which are illustrations of the prior art McGrath antenna system. The beamforming lens system of FIG. 1 includes a planar lens 300, which contains antenna elements which have distributions and variations of transmission line lengths that simulate a distribution of effective feed elements 301 distributed over a concave focal surface 310.

The lengths of transmission line joining elements of opposing faces varies as a function of radius, and the back face elements are displaced radially (they are not directly behind their corresponding front face elements). The amount of that displacement is also a function of radius. Complete details are given in the discussion presented in the above-cited McGrath patent.

FIG. 2 is a perspective view of a section of microstrip constrained lens which is fabricated to form the specific embodiment of the invention depicted in FIG. 1. It is made up of two printed circuit arrays with elements facing in opposite directions above a common ground plane 400. Each feed side element has a transmission line 401 which is connected by a feed-through 402 to the aperture side element 403.

When the lens of FIG. 2 functions as a receiving antenna, the aperture side element collects radio frequency energy and routes it along the top transmission lie 404 and down the feed-through hole to the bottom transmission line 405. The feed side element 401 then re-radiates that energy toward the feed. For a transmitting antenna, that sequence is reversed.

The aperture side array is photoetched on a double-sided copper-clad printed circuit board. Small holes for the feed-throughs are etched on the other side. The feed side array, etched on single-clad board, is placed back-to-back with the first board, as shown in FIG. 2.

Figure 3:
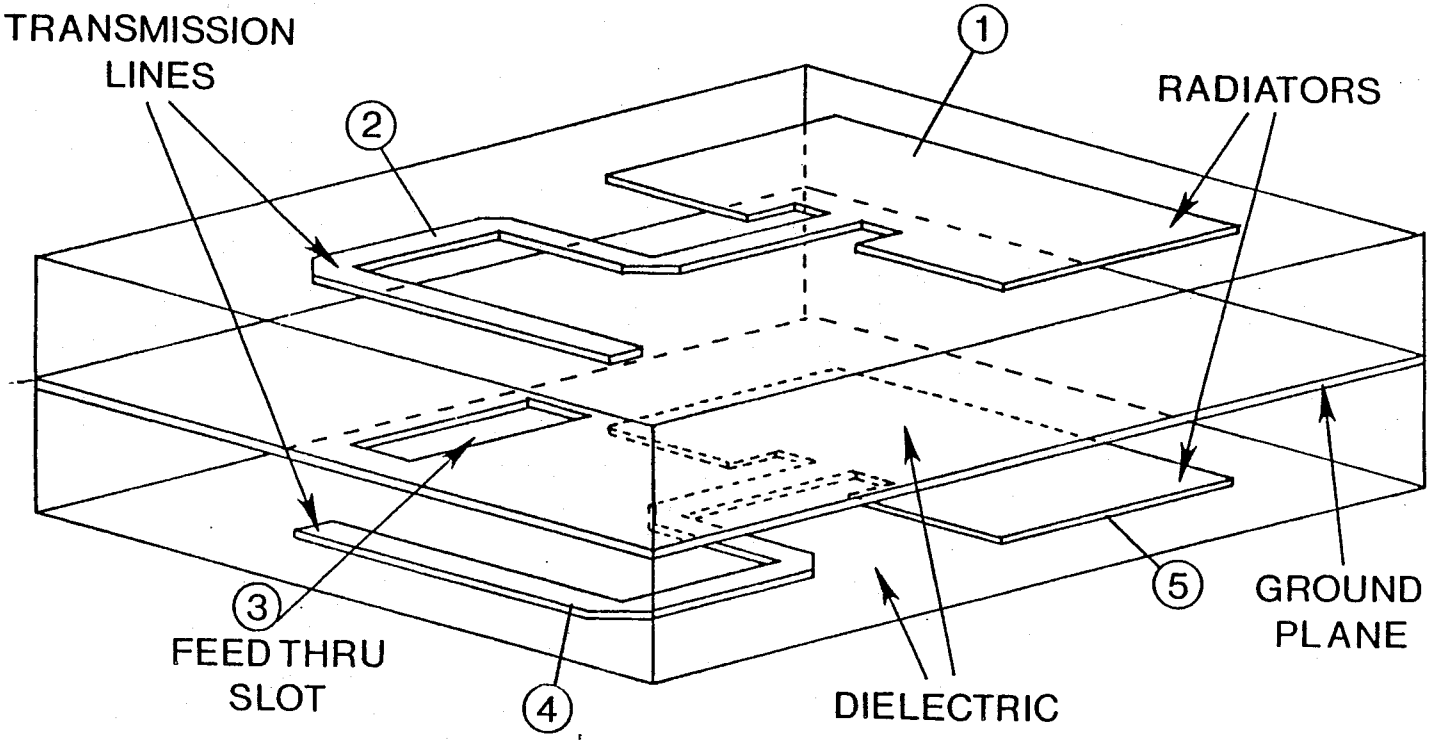
FIG. 3 is a view of the preferred embodiment of the present invention.

FIG. 3 is an illustration of a perspective view of a pair of lens elements of the present invention. The lens elements of FIG. 3 are intended to replace the prior art system of FIG. 2 for use in the microwave antenna of FIG. 1. The system of FIG. 3 resembles that of FIG. 2 in that it contains a pair of radiator antenna elements 1, 5 electrically connected together by a pair of transmission lines 2 and 4. However, the system of FIG. 2 electrically connects the transmission lines with a feed-through pin 402. These feed-through pins were centered in small holes in the ground plane and soldered to the transmission lines, as illustrated in FIG. 2.

The present invention is a modified design that uses a slot coupler for the feed-through mechanism. Its geometry is depicted in FIG. 3. Its obvious advantage is in manufacturability, since there are no pins to be soldered, but its performance is generally better, because the slots are less sensitive to alignment errors. The discussion that follows will first review the theory behind this lens design to show the rationale for the choices of design parameters. The two experimental slot-coupled models (8 $GH_z$ and 12 $GH_z$) will be discussed, with measured data illustrating their performance.

There are four theoretical aspects important to this lens design. First, its wide-angle scanning properties result from the incorporation of two geometric "degrees of freedom": the transmission lines joining front and back face elements vary in length according to the elements' radius from the center of the lens; and the back face elements do not lie directly behind their front face counterparts, but are displaced radially, with the amount of displacement also being a function of radius.

Second, it will be shown that even though it is possible to design this kind of lens with two perfect focal points, better overall scan performance is obtained when it has only one focus. The third and fourth aspects of theory that will be discussed are, respectively, the element design and the slot coupler design.

The present is a "bootlace" lens of the general type described in the McGrath patent. Each back face (feed side) element is connected to a front face (aperture side) element by a transmission line. A feed is positioned behind the lens, and the back face captures its radiation. The front face reradiates that energy, after it is collimated by the relative difference in line lengths between the lens center and lens edges. The addition of a second geometric variable ensures good focusing (or collimation) of feeds in a fairly large focal region around the lens axis. That variable is the relative position of front and back face radiators, r and p, respectively.

As shown in FIG. 3, each pair of elements is electrically connected by a narrow slot oriented transverse to the transmission line ends (FIG. 2*b*). The three important parameters are the slot length, the slot width, and the length of transmission line extending past the slot. The slot length and width are based on preliminary results of experimental data by Franchi (unpublished), which we then scaled for the different in frequency and dielectric constant between those experiments and our lens parameters. In the MCL, the slot must be made shorter than that of an optimum coupler so that it does not run underneath any of the patch elements or other parts of the transmission line.

The transmission lines should extend $\lambda_g/4$ past the center of the slot, where $\lambda_g$ is the guide wavelength, minus a "length extension," $\Delta l$. The length extension is due to fringing at the end of the open-circuited line, which makes the line appear electrically longer. A very close approximate expression for the extensions is given by:

$$\Delta l = .412h \frac{(\epsilon_{eff} + .3)(W/h + .264)}{(\epsilon_{eff} - .258)(W/h + .8)} \quad (1)$$

where $\epsilon_{eff}$ is the effective dielectric constant, W is the line width and h is the substrate thickness. The slot dimensions for the couplers are listed in Table 1.

TABLE 1

| Parameter | Lens Design Parameters 8 GHz Lens | 12 GHz Lens |
|---|---|---|
| Aperture Diameter, D | 20" | 20" |
| Focal Length, F | 20" | 30" |
| On-Axis Beamwidth | 5.2° | 3.5° |
| Microstrip Pathc | | |
| Length, b | .327" | .213" |
| Width, a | .457" | .258" |
| Inset, d | .095" | .062" |
| Transmission Lines | | |
| Width, w | .060" | .039" |
| Impedance, Z° | 71 ohms | 85 ohms |
| Slot Coupler | | |
| Slot Length | .240" | .160" |
| Slot Width | .050" | .033" |

Figure 4:
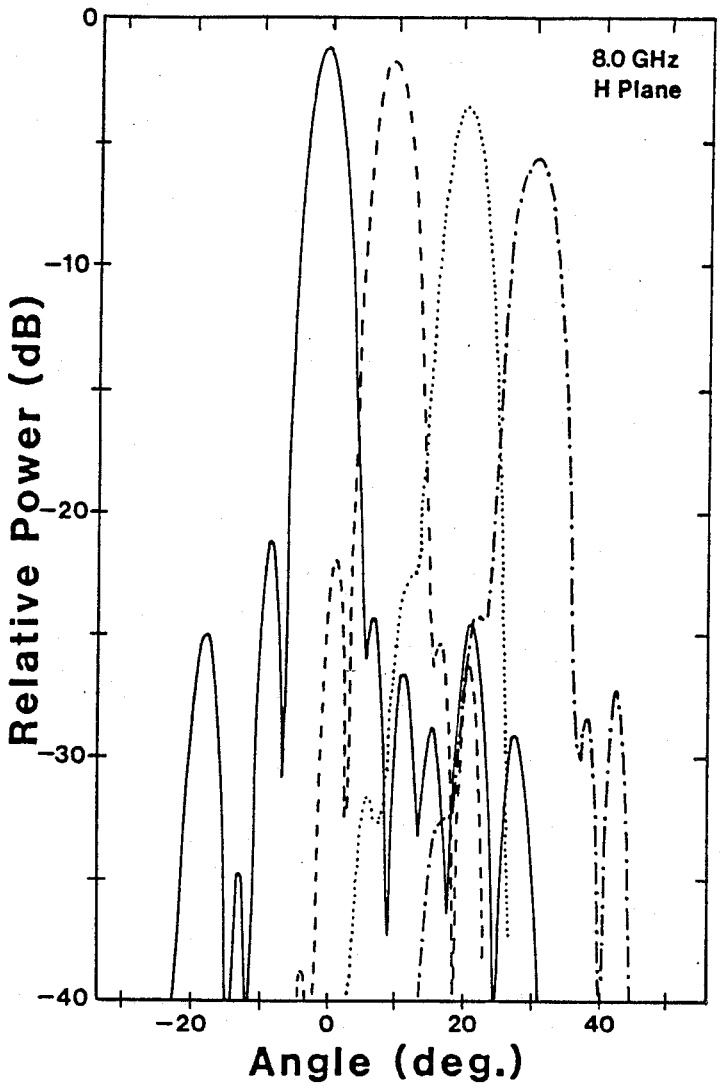
FIG. 4 is a chart of the H plane patterns of the system of FIG. 2 for an 8 $GH_z$ lens.
Figure 5:
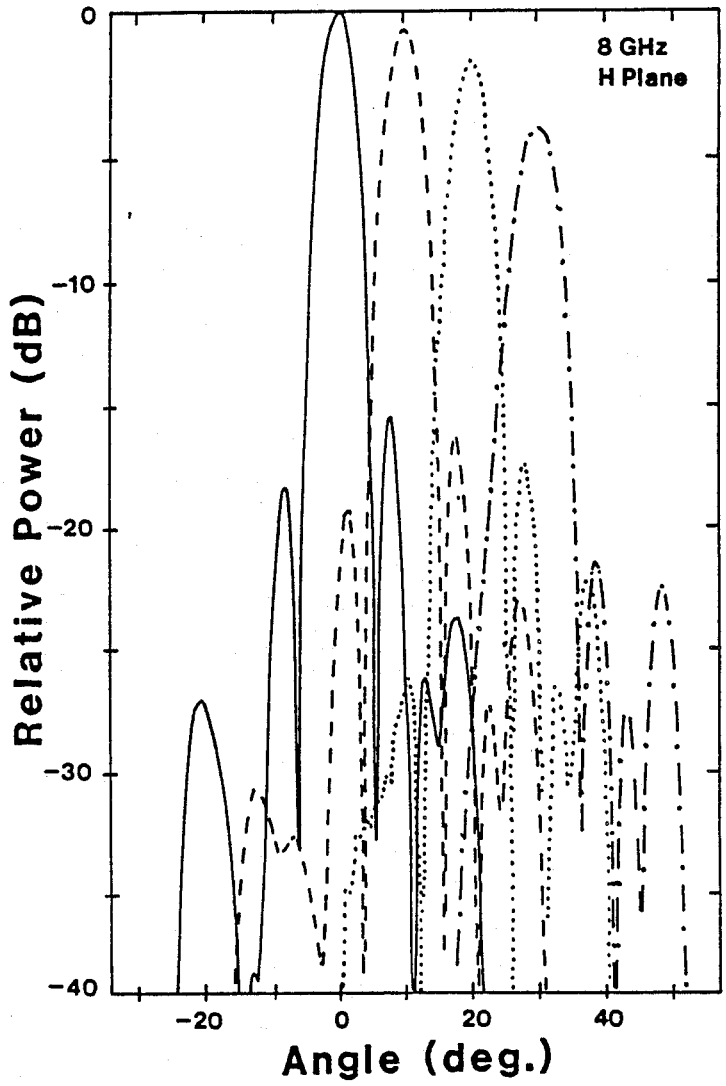
FIG. 5 is chart of the H Plane patterns of the system of FIG. 3 for an 8 $GH_z$ lens.

The new 8 $GH_z$ lens was intended to directly replace the earlier pin-coupled version, so it has the same 40" focal length and 20" aperture diameter FIG. 4 shows scanned patterns of that earlier lens. Although these tended to demonstrate its wide angle scanning properties, the pattern shape is poor, and the peak gain indicated an overall efficiency of only 29%. The new lens is only slightly better in the latter respect (31%). This tends to indicate that the feed-through mechanism has the same amount of loss. The H-plane scanned patterns shown in FIG. 5 are much better focused than those in FIG. 4. We attribute this to better alignment of the feed-throughs, which was a major source of error in the pin-coupled lens. The new lens has about 8% bandwidth, measured between −3 dB gain points.

Figure 6:
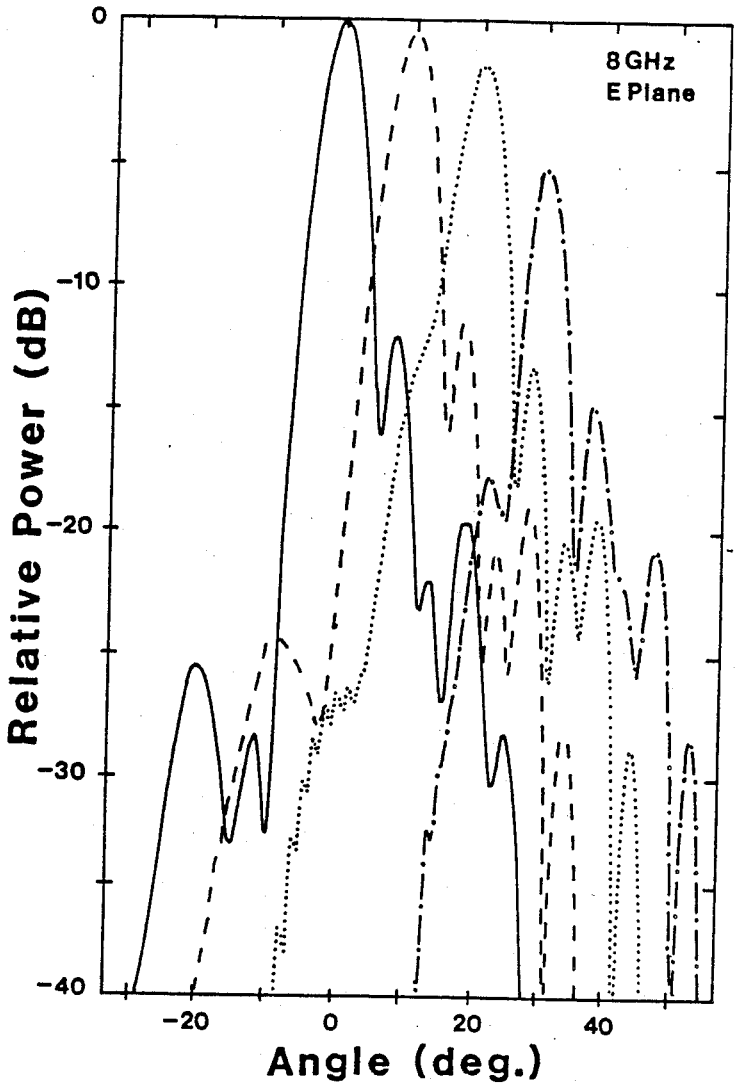
FIG. 6 is a chart of the E plane patterns of the system of FIG. 3 for an 8 $GH_z$ lens.

The E-plane scans are shown in FIG. 6. Their asymmetry may be due to the close proximity of the feed lines to patch radiating edges, which is worse in some regions of the array than others. This could be avoided by using smaller transmission line bends. Stray radiation from the feed-throughs is another possible source since they all lie on the same side of the patches in the E plane, they would tend to corrupt the patterns more in that plane.

Reflection from the feed-throughs can be estimated by the relative strength of the back lobe, which we observed by scanning the feed to about 2° off axis, and measuring the pattern in the direction opposite the main beam (with the absorber shroud removed). In the very first lens version, we had observed a well-focused back lobe. Since the total transmission line length is divided equally between the two faces, energy that is received by one face and reflects from the feed-throughs to be reradiated by the same face will tend to be focused. By contrast, energy that reflects directly from the surface will radiate with the unfocused feed horn pattern. In this new version, the back lobe is 4 dB lower than the main beam. Thus, the feed-throughs and surface reflection together account for about 1.5 dB of the total loss. Another 1.5 dB is lost in the transmission lines, since the circuit board material is epoxy-fiberglass, which is fairly lossy. Use of low loss substrate would improve the lens efficiency by up to 10%.

The conclusions one may draw from this experiment is that the slot coupled lens performs at least as well as the pin coupled lens in all respects, but that the coupler design still needs some improvement to reduce its reflection.

The 12 $GH_z$ lens was a much more demanding case. Its focal length is 30", with the same 20" aperture diameter. The reduced F/D ratio increases the disparity in line lengths between the center and edges.

The reduced focal length also increases the distance between front and back face elements, p-r. Near the edges, that distance was so large that the mask layout problem was intractable. To make that job easier, we chose to expand the front fact lattice (after calculating the back face element locations and transmission line lengths) by a constant. The "K" factor, the inverse of the expansion constant, was about 0.96. Its side effect is that it changes the beam scan angle. A feed located at angle $\theta$ will produce a beam at a different angle, $\Psi$:

$$\sin \Psi / \sin \theta = K. \quad (2)$$

The initial front face coordinates, r, were calculated for an equilateral lattice with slightly reduced element spacing to prevent grating lobes with the later expanded lattice.

This lens was fed with a pyramidal horn whose aperture dimensions are 2.1"×2.5", and gave an edge taper of about 6 dB. The lens' gain was measured at 22.7 dBi, which was the peak at 11.8 $GH_z$. The bandwidth between 19.7 dBi gain points is about 9%. Feed horn losses, taper loss and spillover loss are estimated at 6.5 dB. The estimated efficiency is 18%. Of the losses in the lens, 2.5 dB is dissipated in the transmission lines. Since the back lobe is 1.1 dB higher than the main beam, the feed-through and surface reflection losses account for over half the total loss.

Figure 7:
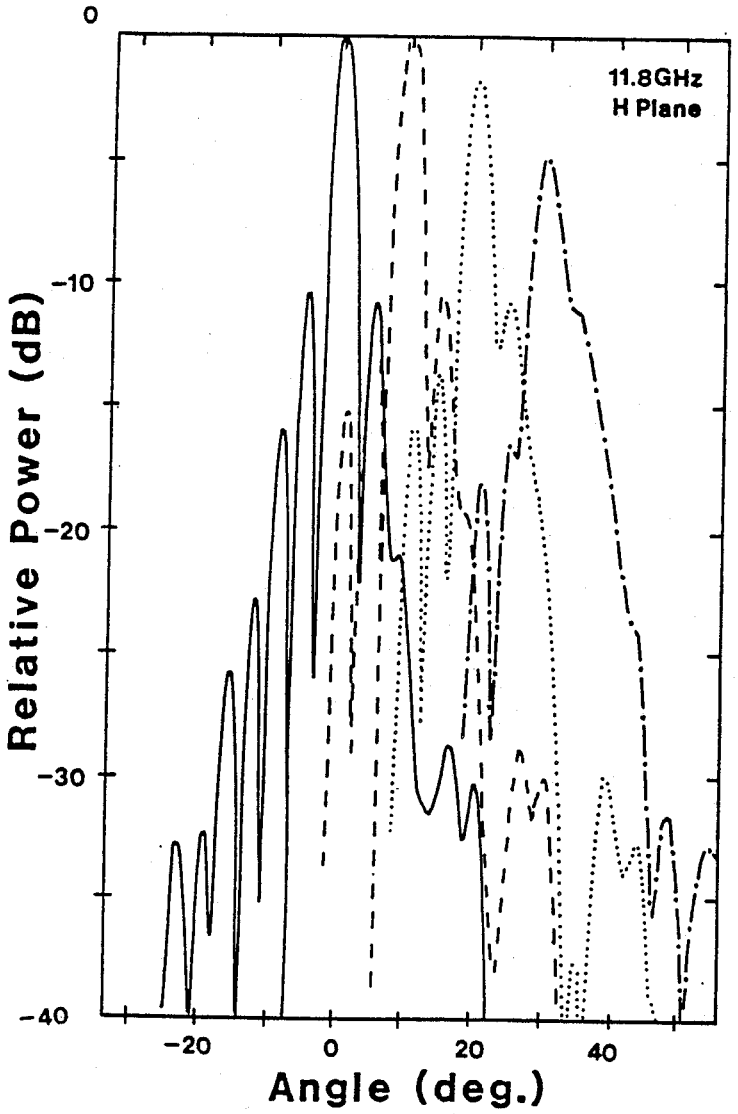
FIGS. 7 and 8 respectively are charts of the H and E plane patterns of the system of FIG. 3 for an 11.8 $GH_z$ lens.
Figure 8:
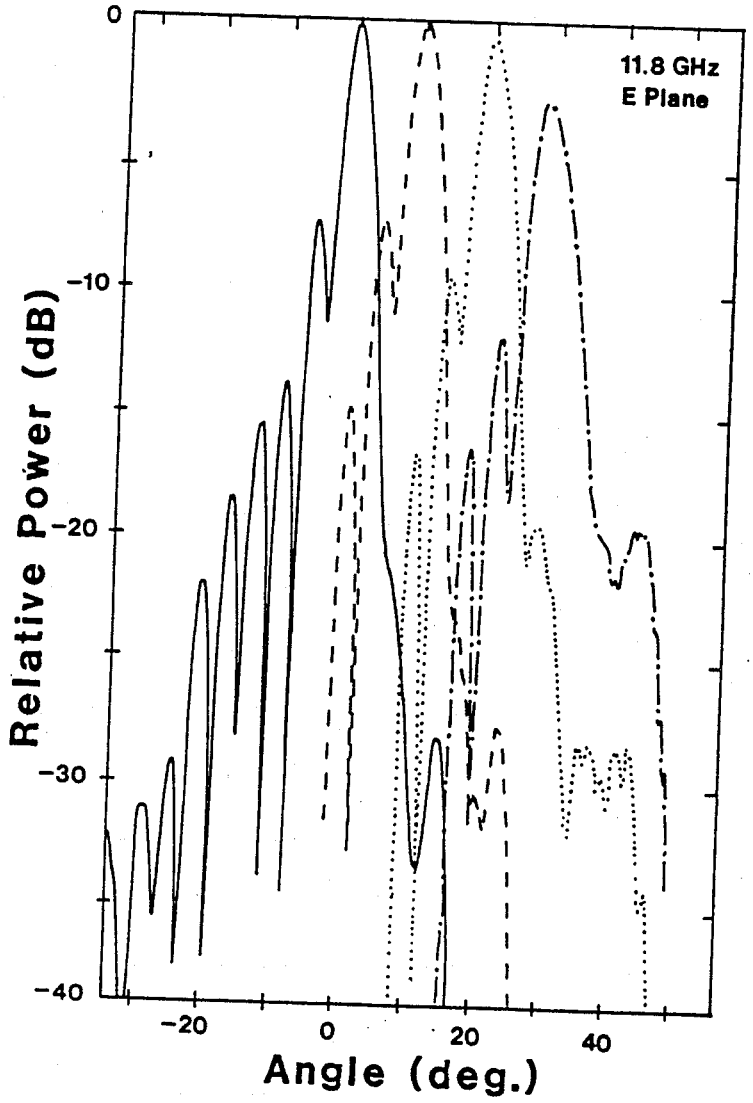
Figure 9:
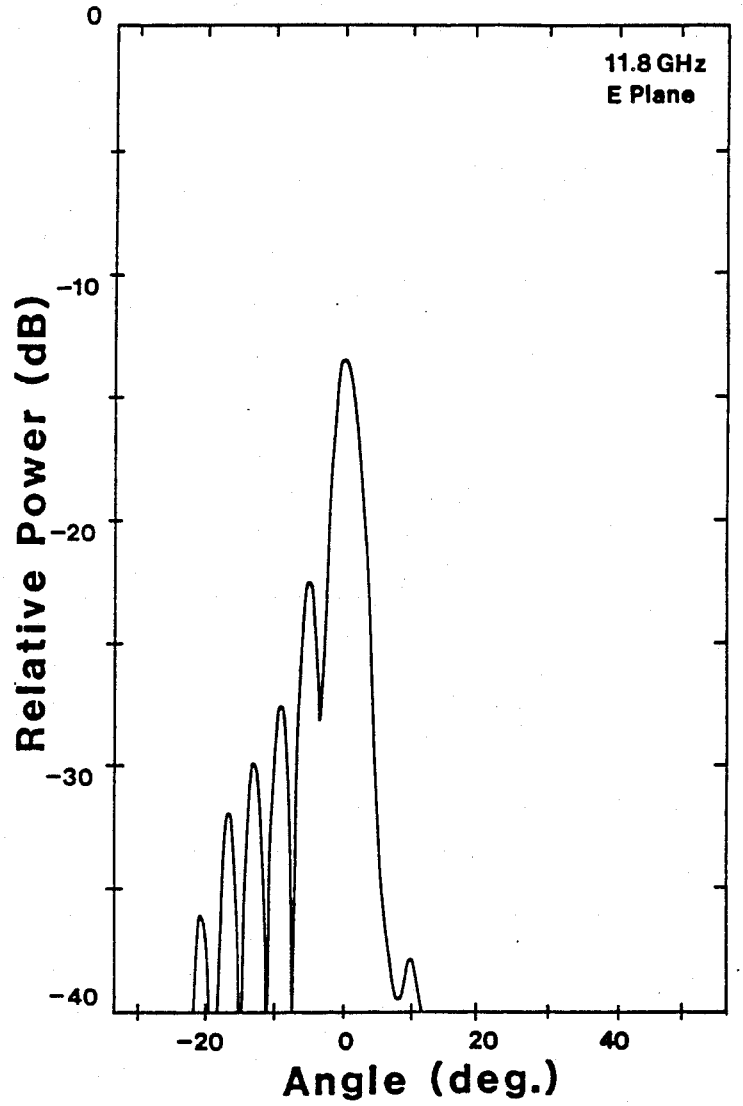
FIG. 9 is a chart of the cross polarized E plane patterns at 11.8 $GH_z$ for the system of FIG. 3.

H plane and E plane scanned patters are shown in FIGS. 7 and 8, respectively. The sidelobes in these are considerably higher than they should be, which is due to two factors: first, the transmission lines come too close to the patch radiating edges, and that is much more severe a problem than it was in the 8 $GH_z$ lens because the smaller inter-element spacing leaves less room for the lines. Second, there is appreciable radiation from the slot couplers. FIG. 9 is the cross polarized pattern, whose peak is only 14 DB below that of the co-polarized pattern. Evidently, the feed through will capture cross polarized energy from the far field and route it along the transmission lines to be re-radiated by the back face. Since it has then gone through the differential line lengths, it is partially focused.

From these experiments, one may draw the following conclusions: (1) the microstrip constrained lens can form beams to at least 12 beamwidths off axis in any $\phi$ plane; (2) a better feed through design and low loss substrate would increase efficiency substantially; and (3) close proximity of transmission lines to patch radiating edges needs to be avoided, although it will further complicate the mask layout.

These experimental models have shown that the microstrip constrained lens is a viable antenna system. It is very lightweight and inexpensive and easy to construct, especially with the slot type feed throughs. It can scan to moderately wide angles due to the use of two degrees of freedom, and thus lends itself to electronic scanning applications. Although the experimental models had fairly low efficiencies, minor improvements can raise that substantially, and those are suggested areas for further research: efficient slot couplers; wide angle impedance matching to reduce surface reflection; and low loss substrate to reduce transmission line attenuation.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A slot coupled microwave beamforming lens system comprising:

a planar lens which has an aperture side and a feed side;

a plurality of apertures side antenna elements which are housed upon said aperture side of said planar lens, said aperture side antenna elements being regularly distributed over said aperture side;

a plurality of feed side antenna elements which are housed upon said feed side of said planar lens with a distribution that varies as a function of radius to provide a first degree of freedom to said microwave array beamforming lens system;

a plurality of aperture side transmission lines with lengths that vary as a function of radius of said planar lens to help provide a second degree of freedom in said planar microwave array beamforming lens, each of said plurality of aperture side transmission lines being electrically connected to one of said aperture side antenna elements;

a plurality of feed side transmission lines with lengths that vary as a function of radius of said planar lens to help provide said second degree of freedom, each of said plurality of feed side transmission lines being electrically connected to one of said feed side antenna elements; and a metal ground plane which is fixed in parallel between said aperture side and feed side antenna elements and said aperture side and feed side transmission lines, said metal ground plane having a plurality of feed-through slots, each of which electrically connect one said aperture transmission lines with one of said feed side transmission lines by having each of said plurality of feed-through shots being positioned directly between one of said plurality of aperture side and feed side transmission lines so that they extend just past said feed-through slot's center, so that each of said feed-through slots can conduct microwave energy therebetween.

2. A slot coupled microwave beamforming lens system, as defined in claim 1, wherein said microwave energy has wavelengths that may range between about 8 and 12 gigahertz, and wherein each of said plurality of feed-through slots have a slot length ranging between about 0.24 and 0.16 inches.

3. A slot coupled microwave beamforming lens system, as defined in claim 2, wherein said aperture side and said feed side transmission lines each have a width ranging between about 0.06 and 0.039 inches.

4. A slot coupled microwave beamforming lens system, as defined in claim 2, wherein said aperture side and said feed side transmission lines each have a width ranging between about 0.06 and 0.039 inches.

5. A slot coupled microwave beamforming lens system, as defined in claim 3, wherein each of said feed side transmission lines have impedance values ranging between about 71 and 85 ohms.

6. A slot coupled microwave beamforming lens system comprising:

a planar lens which has an aperture side and a feed side;

a plurality of aperture side antenna elements which are housed upon said aperture side of said planar lens, said aperture side antenna elements being regularly distributed over said aperture side;

a plurality of feed side antenna elements which are housed upon said feed side of said planar lens with a distribution that varies as a function of radius to provide a first degree of freedom to said microwave array beamforming lens system;

a plurality of aperture side transmission lines with lengths that vary as a function of radius of said planar lens to help provide a second degree of freedom in said planar microwave array beamforming lens, each of said plurality of aperture side transmission lines being electrically connected to one of said aperture side antenna elements, with impedance values ranging between 71 and 85 ohms;

a plurality of feed side transmission lines with lengths that vary as a function of radius of said planar lens to help provide said second degree of freedom, each of said pluralitry of feed side transmission lines being electrically connected to one of said feed side antenna elements; and a metal ground plane which is fixed in parallel between said aperture side and feed side antenna elements and said aperture side and feed side transmission lines, said metal ground plane having a plurality of feed-through slots, each of which electrically connect one of said aperture transmission lines with one of said feed side transmission lines having each of said plurality of feed-through slots being positioned directly between one of said plurality of aperture side and feed side transmission lines so that they extend just past said feed-through slots center, so that each of said feed-through slots can conduct microwave energy therebetween, and wherein said microwave energy has wavelengths that may range between about 8 and 12 gigahertz, and wherein each of said plurality of feed-through slots have a slot length ranging between about 0.24 and 0.16 inches.

* * * * *